US005653848A

United States Patent [19]

Yamamoto et al.

[11] Patent Number: 5,653,848

[45] Date of Patent: Aug. 5, 1997

[54] TAPE JOINING DEVICE

[75] Inventors: Hidekimi Yamamoto; Seiji Sato; Micho Ueda, all of Tokushima, Japan

[73] Assignee: Shikoku Kakoki Co. Ltd., Tokushima, Japan

[21] Appl. No.: 539,557

[22] Filed: Oct. 5, 1995

[30] Foreign Application Priority Data

Oct. 7, 1994 [JP] Japan ..... 6-243830

[51] Int. Cl.[6] ..... B65H 21/00

[52] U.S. Cl. ..... 156/504; 156/159; 156/251; 156/502; 156/515; 242/555; 242/556

[58] Field of Search ..... 156/157, 159, 156/251, 502, 504, 515; 242/552, 555.6, 556

[56] References Cited

U.S. PATENT DOCUMENTS 2,724,426 11/1955 Bell et al. .
3,550,425 12/1970 Callioux ..... 100/258 A X
3,763,690 10/1973 Kirincic et al. ..... 100/258 A X
4,204,898 5/1980 King .
4,946,541 8/1990 Thies et al. ..... 100/258 A X
5,193,452 3/1993 Dieperink ..... 100/258 A X
5,249,951 10/1993 Leonhartsberger et al. .... 100/258 A X
5,273,228 12/1993 Yoshida et al. ..... 156/502 X

*Primary Examiner*—Mark A. Osele
*Attorney, Agent, or Firm*—Armstrong, Westerman, Hattori, McLeland, & Naughton

[57] ABSTRACT

A tape joining device has a fixed bearing member 24 and a movable pressing member 46 arranged respectively at opposite sides of the portions of two tapes T to be joined, and a heater 88 for heating the pressing member 46. The pressing member 46 is attached to a movable body 44 for pressing the pressing member 46 against the bearing member 24 with the opposed tape portions positioned therebetween. The pressing member 46 is pivotally movable relative to the movable body 44 about an axis extending in parallel to the longitudinal direction of the tapes T.

5 Claims, 8 Drawing Sheets

TAPE JOINING DEVICE

BACKGROUND OF THE INVENTION

The present invention relates to a tape joining device for joining the rear end of a preceding tape to the leading end of a subsequent tape for use in continuously rewinding the two tapes. Such tapes are, for example, liquid penetration preventing seal tapes for covering ends of container blanks of paperbase laminate.

As disclosed, for example, in JP-A-4-105060 (U.S. Pat. No. 5,273,228), devices of the type mentioned are already known which comprise means for holding two tapes at portions thereof opposed to each other for joining, a fixed bearing member disposed at one of opposite sides of the opposite tape portions and having a bearing surface opposed to the opposed tape portions, a movable pressing member disposed at the other side of the opposed tape portions and having a pressing face opposed to the bearing surface, a heater for heating the pressing member, and a movable body having attached thereto the pressing member and movable toward or away from the bearing member so as to press the pressing face against the bearing surface with the opposed tape portions interposed therebetween.

When the pressing face is not accurately parallel to the bearing surface in the conventional device described above, the tape portions to be joined together can not be sealed uniformly over the entire width of the tape. In order to hold the bearing surface and the pressing face accurately in parallel, it is practice to manually adjust the installed positions of the bearing member and the pressing member relative to the movable body, but the adjusting procedure is cumbersome and difficult.

SUMMARY OF THE INVENTION

An object of the present invention is to provide a tape joining device wherein the pressing face of a pressing member can be held accurately in parallel to the bearing surface of a bearing member without adjusting the position where the pressing member is installed.

The present invention provides a tape joining device for joining two heat-sealing tapes in alignment with each other which device comprises means for holding the two tapes at portions thereof opposed to each other for joining, a fixed bearing member disposed at one of opposite sides of the opposed tape portions and having a bearing surface opposed to the opposed tape portions, a movable pressing member disposed at the other side of the opposed tape portions and having a pressing face opposed to the bearing surface, a heater for heating the pressing member, and a movable body having attached thereto the pressing member and movable toward or away from the bearing member so as to press the pressing face against the bearing surface with the opposed tape portions interposed therebetween, the tape joining device being characterized in that the pressing member is pivotally movable relative to the movable body about an axis extending in parallel to the longitudinal direction of the tapes held by the holding means.

With the tape joining device of the present invention, the pressing member is pivotally movable relative to the movable body about an axis extending in parallel to the longitudinal direction of the tapes held by the holding means. Accordingly, even if the pressing face is not parallel to the bearing surface, the pressing member is pivotally moved so as to position the pressing face in parallel to the bearing surface when the pressing face is pressed against the bearing surface.

Thus, the pressing face of the pressing member can be held accurately in parallel to the bearing surface of the bearing member without adjusting the installed position of the pressing member. Furthermore in the event of the bearing member or the pressing member mechanically backlashing, the backlash can be absorbed.

Figure 4:
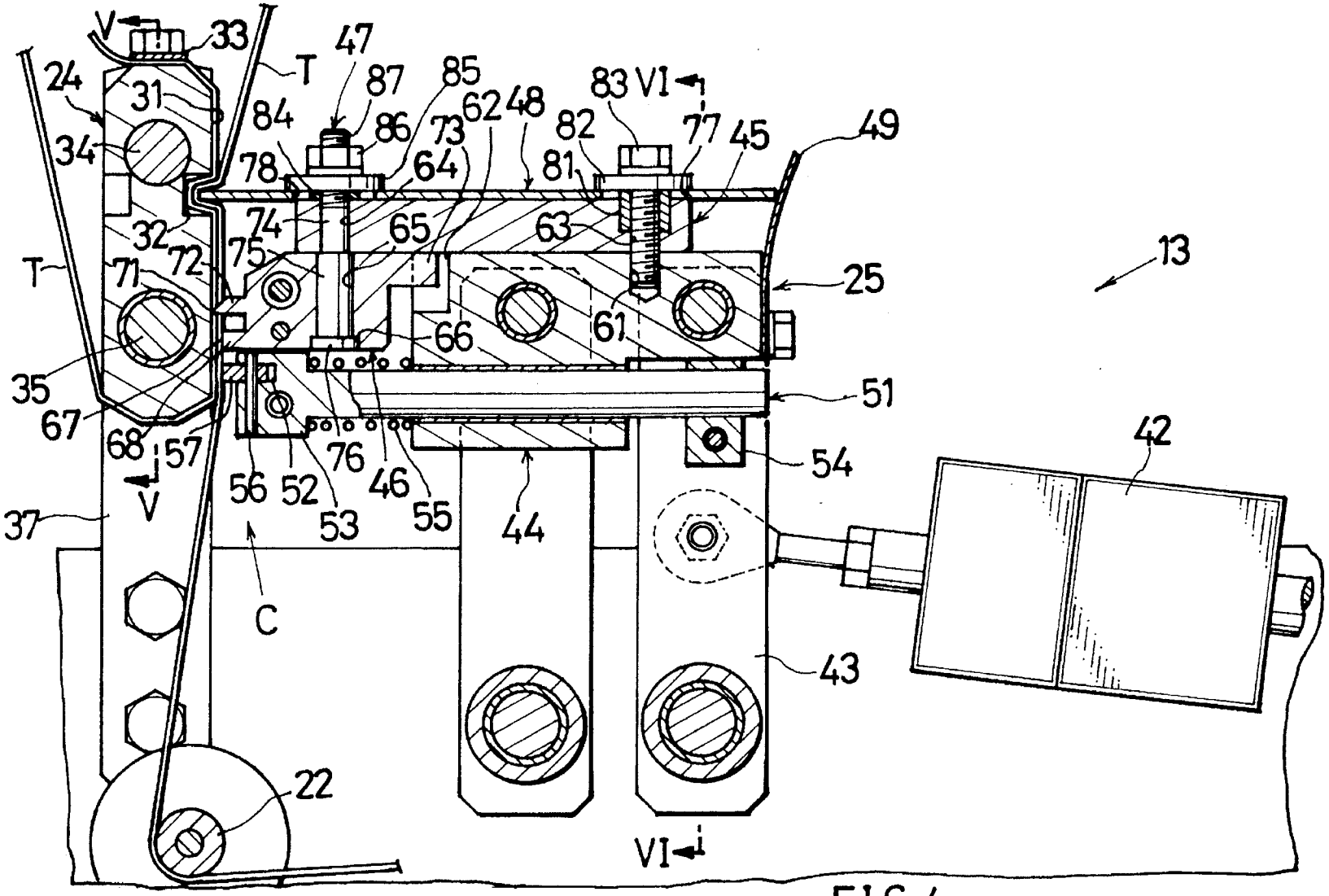
Figure 5:
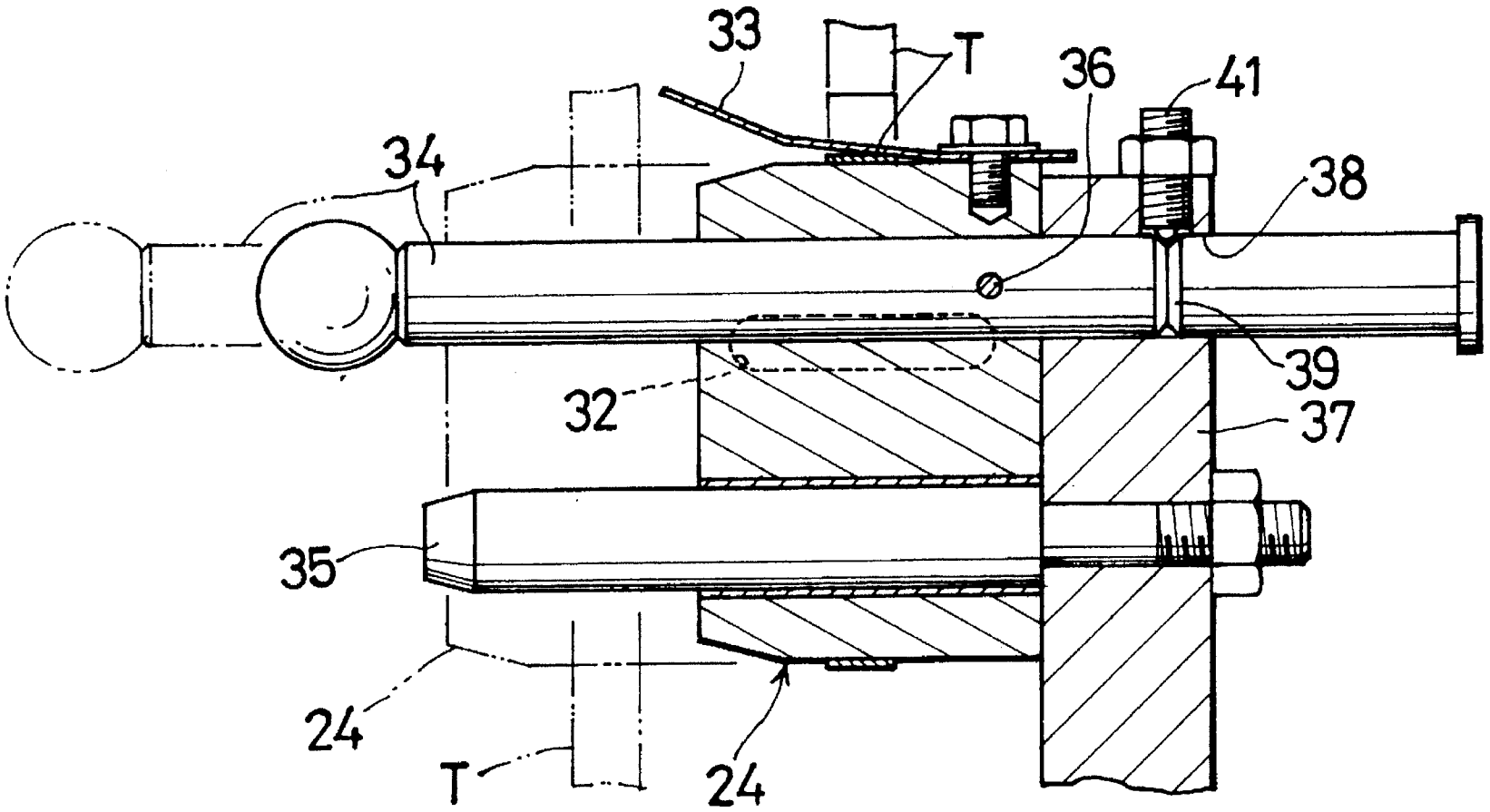
Figure 6:
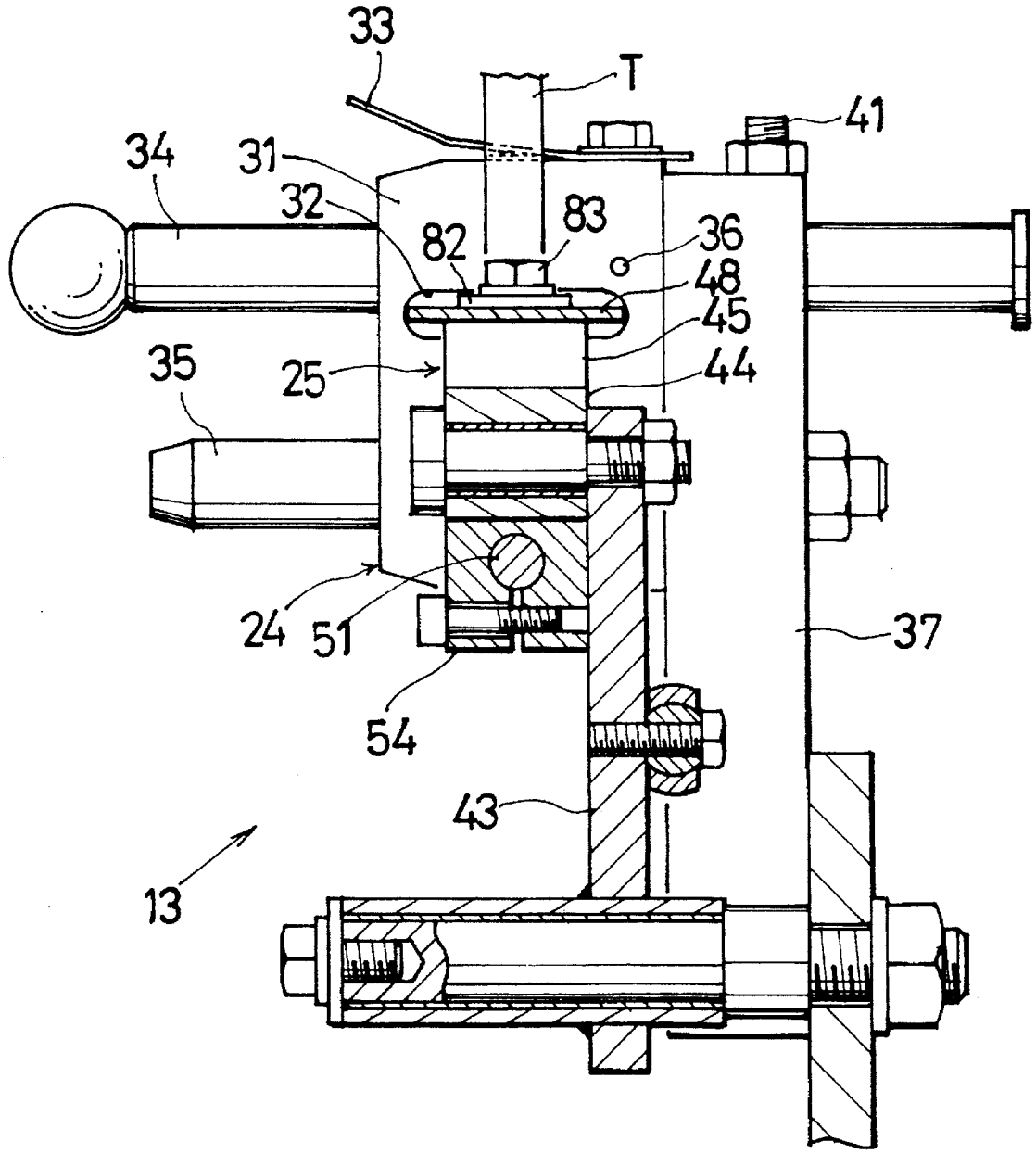
Figure 7:
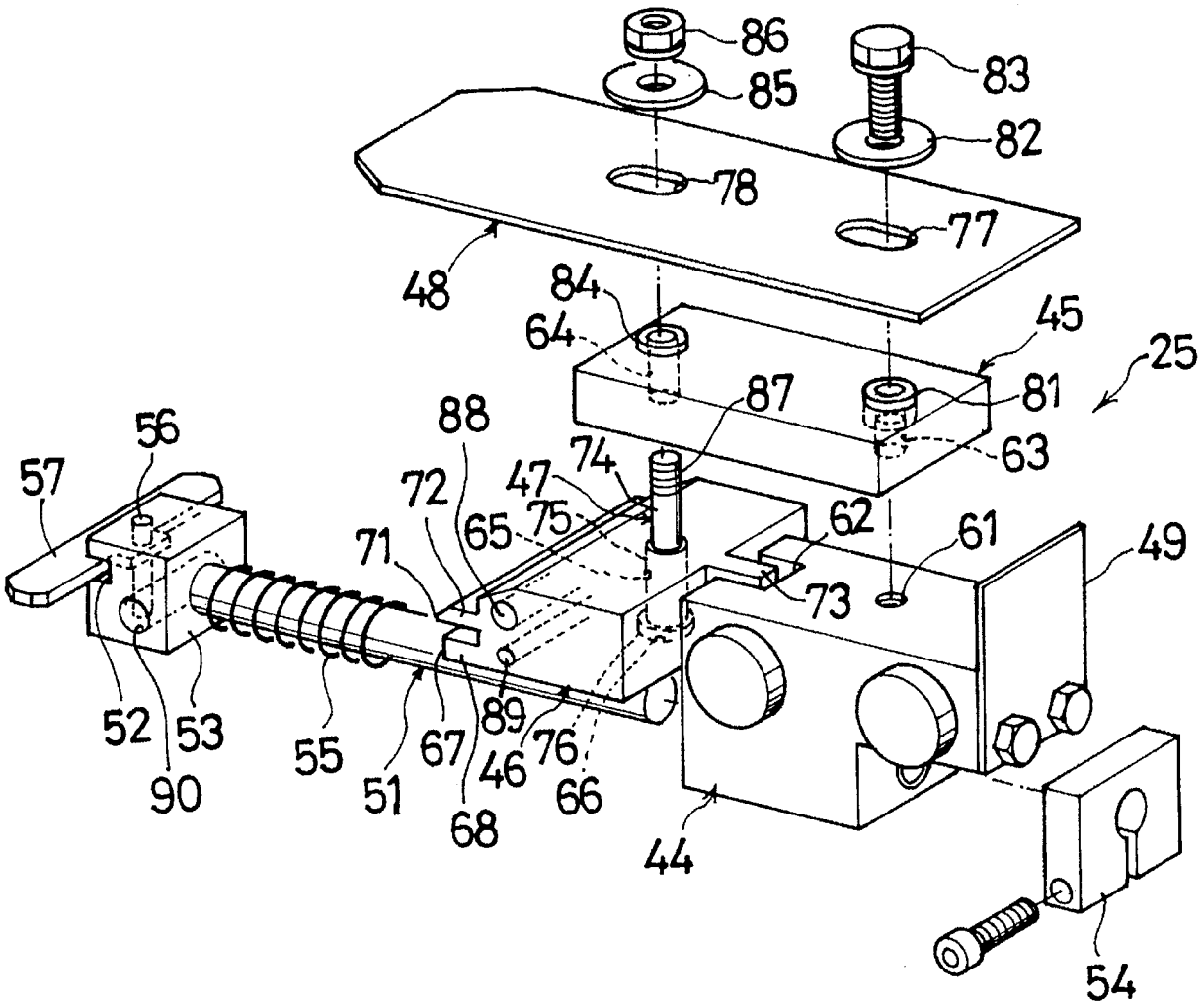

PIG. 4 is a view in vertical section of the device;

FIG. 5 is a view in section taken along the line V—V in FIG. 4;

FIG. 6 is a view in section taken along the line VI—VI in FIG. 4;

FIG. 7 is an exploded fragmentary perspective view of the device; and

Figure 8:
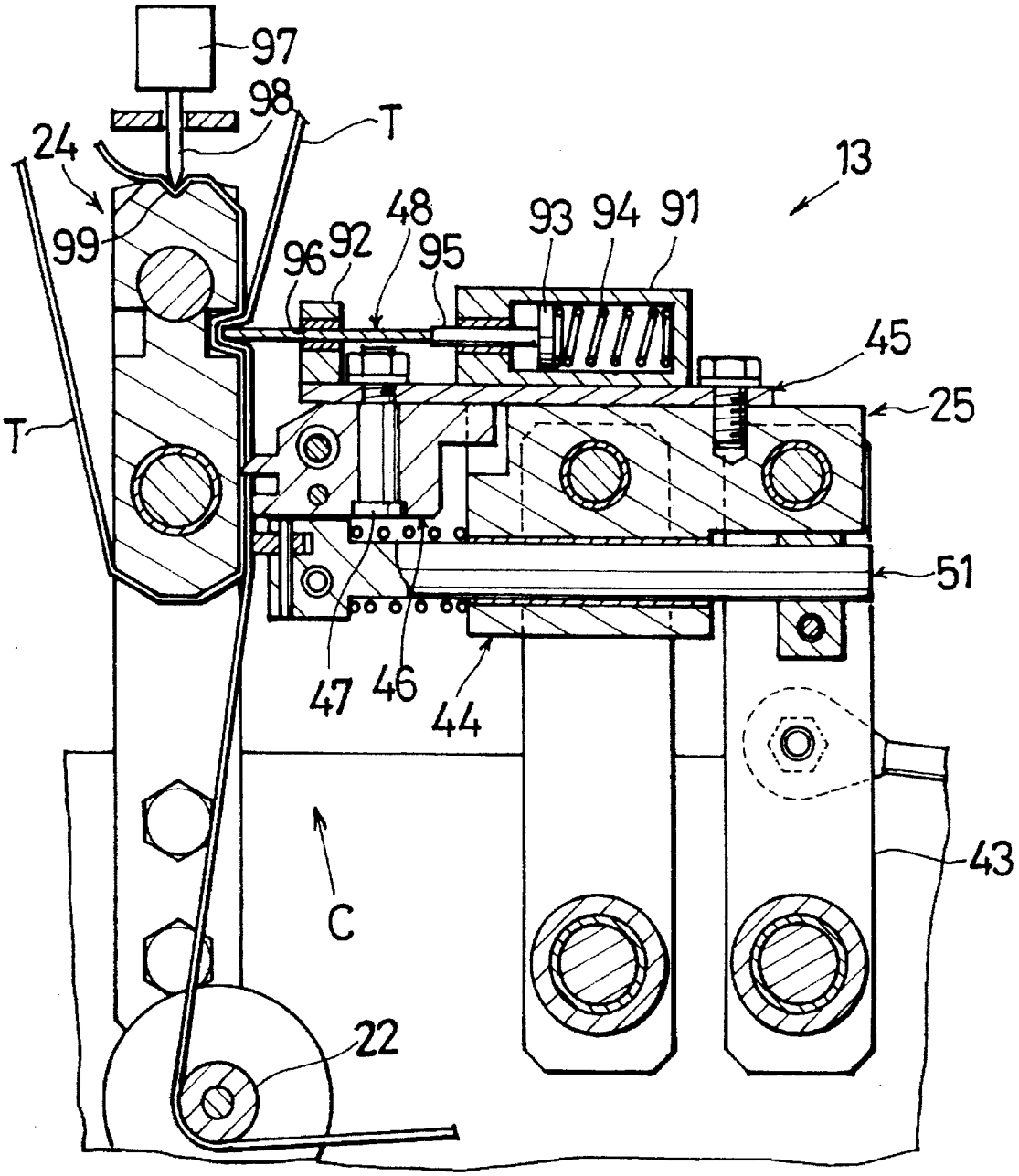

FIG. 8 is a sectional view corresponding to FIG. 4 and showing another example of tape pushing member.

DESCRIPTION OF THE PREFERRED EMBODIMENT

Figure 3:
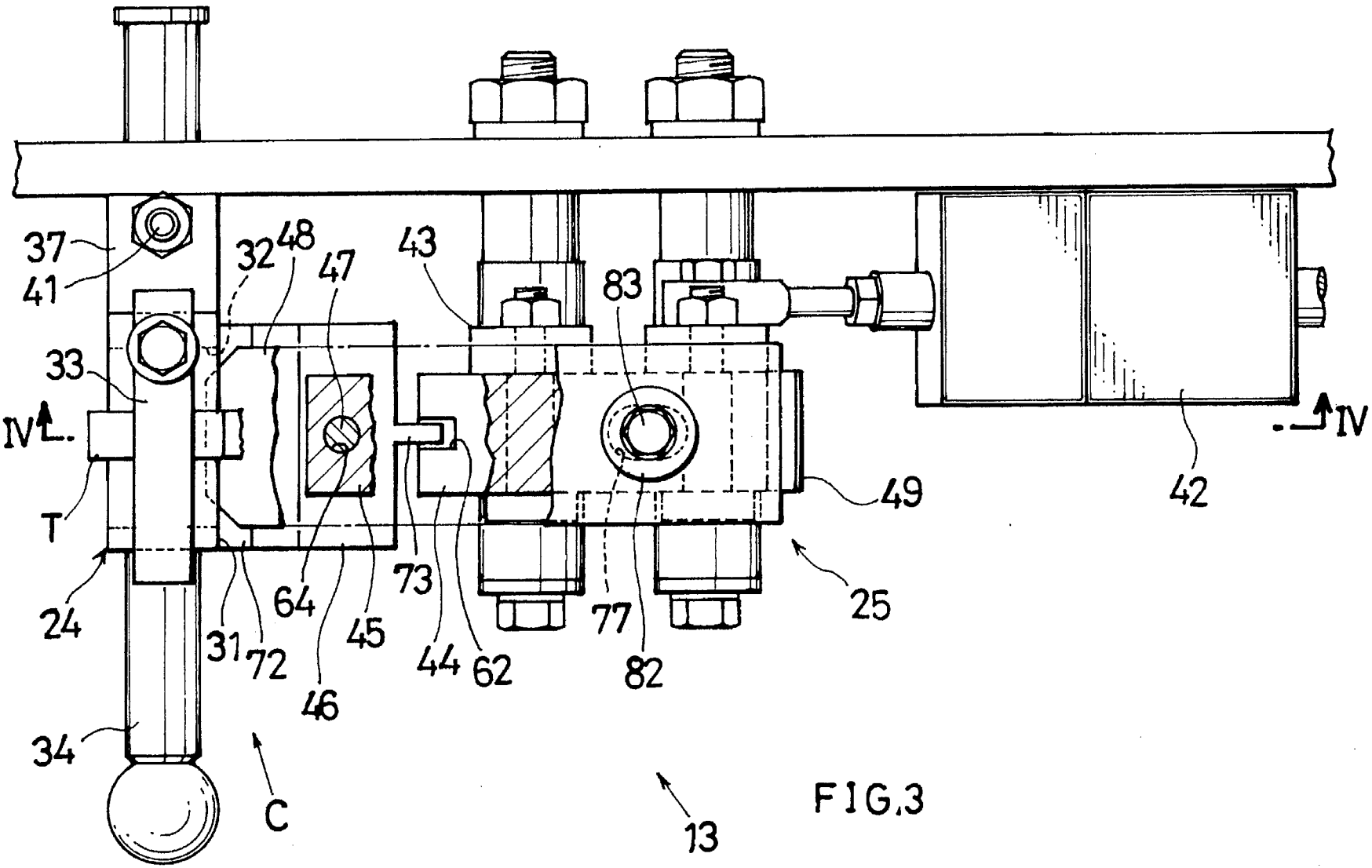
FIG. 3 is a plan view of the device.

In the following description, the terms "front" and "rear" are used based on FIG. 1; the front side of the plane of this drawing will be referred to as "front" (the lower side of FIG. 3), and the opposite side as "rear." The terms "right" and "left" refer respectively to the right-hand side and the left-hand side of FIG. 1.

Figure 1:
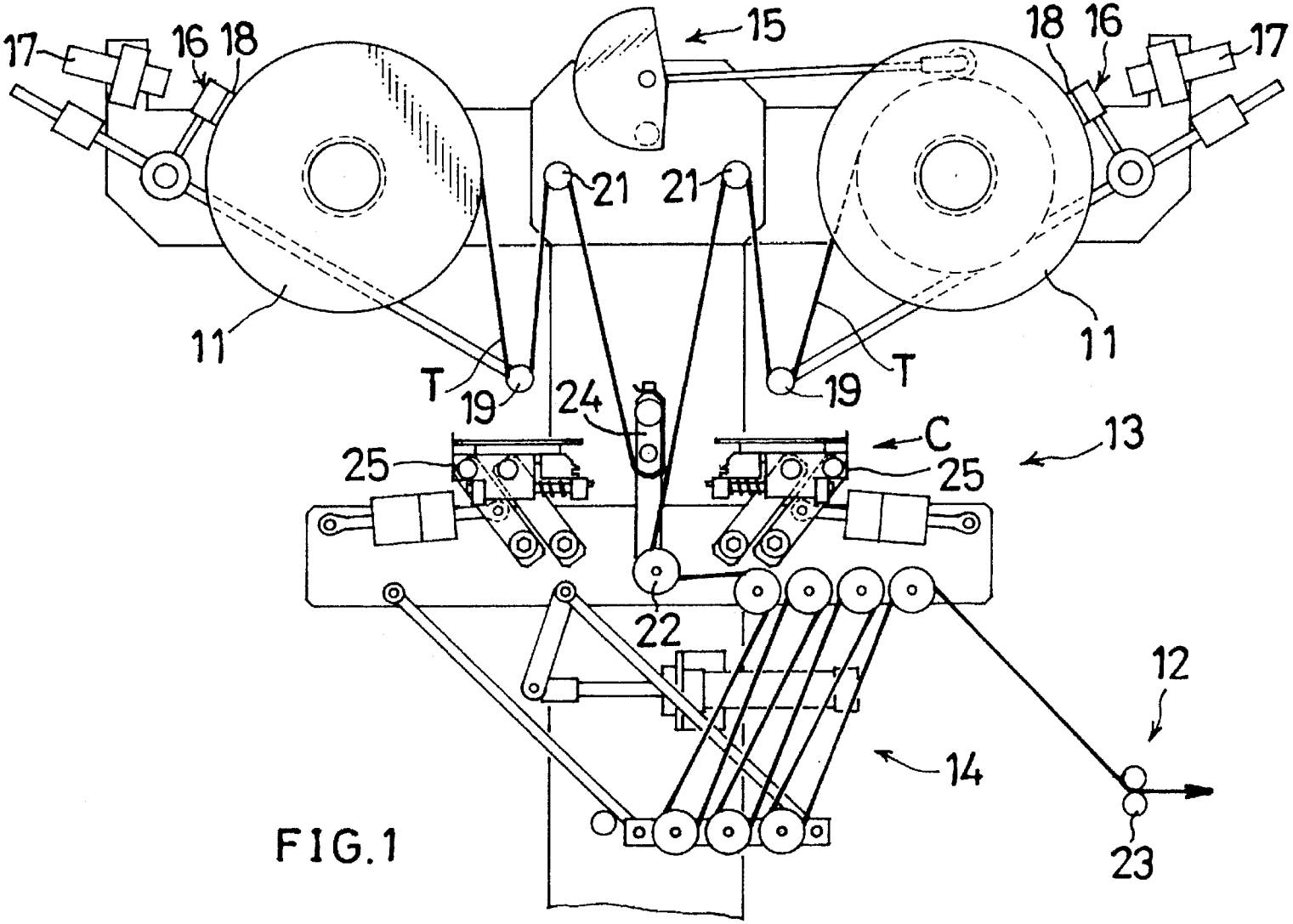
FIG. 1 is a front view showing a tape rewinding apparatus including a tape joining device according to the invention.

FIG. 1 shows a taper rewinding apparatus including a tape joining device according to the present invention. Tapes T are made of polyethylene and has a thickness of 0.05 mm and a width of about 8 mm.

The tape rewinding apparatus comprises two rewinders 11 each carrying a role of tape T, transport means 12 for transporting the tape T via a joining station C while unwinding the tape T alternately from the two rewinders 11, the tape joining device 13 for joining the rear end of a preceding tape T to the leading end of a subsequent tape T at the joining station C, and an accumulator 14 for accumulating the tape T for enabling the transport means 12 to continuously transport the tape without an interruption while the device 13 joins the two tapes.

Disposed between the two rewinders 11 is a tape sensor 15 operable commonly for the rewinders to detect the remaining quantity of tape. Each of the two rewinders 11 is further provided with an L-shaped brake lever 16 and a tape rear end sensor 17. The brake lever 16 has one end carrying a brake shoe 18 and the other end carrying a tension roller 19.

The tape transport means 12 comprises two upper guide rollers 21 arranged above the joining station C inwardly of the two rewinders 11, a lower guide roller 22 disposed upstream from the accumulator 14 below the station C, and drive pinch rollers 23 arranged downstream from the accumulator 14.

The tape joing device 13 comprises a bearing member 24 positioned at an intermediate level between the upper guide rollers 21 and the lower guide roller 22, and a pair of right and left seal units 25.

Figure 2:
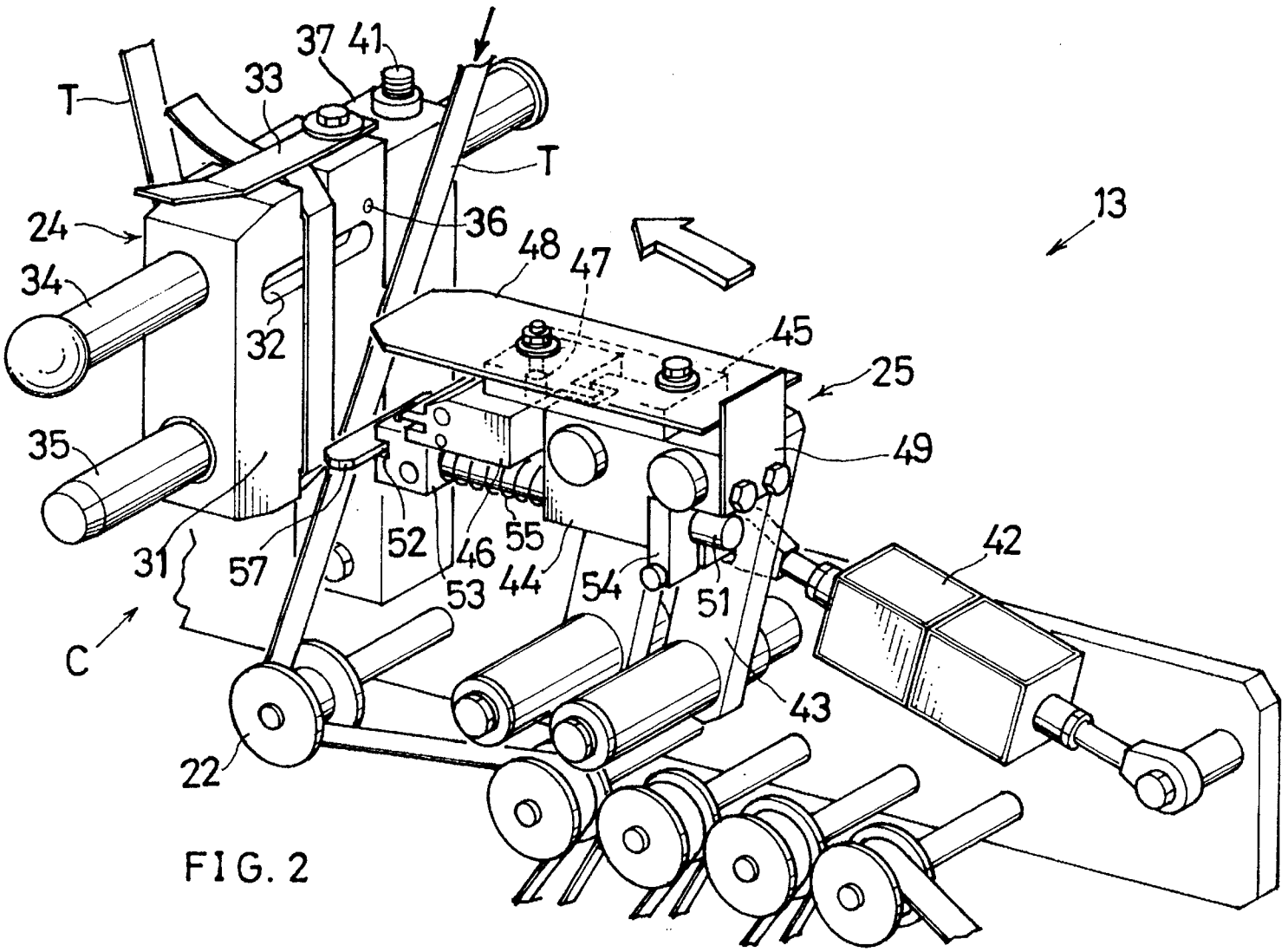
FIG. 2 is a perspective view of the device.

Referring mainly to FIG. 2, the bearing member 24 is in the form of a vertically elongated rectangular parellelepipedal block having a thickness in the right-to-left direction, and has a vertical bearing surface 31 on each of its right and left sides. The bearing surface 31 is formed with a horizontal tape receiving groove 32 extending in the front-rear direction and positioned slightly above the midportion of height of the member 24. The groove 32 is, for example, 30 mm in length and 4 mm in width. A tape holder 33 prepared from a plate spring is attached to the top of the bearing member 24.

With reference to FIG. 5, the bearing member 24 has a horizontal handle rod 34 extending through an upper portion thereof, and a horizontal guide rod 35 slidably extending through a lower portion thereof. The handle rod 34 is fixed to the bearing member 24 with a pin 36. The rod 34 has a rear portion inserted through a guide bore 38 formed in a post 37. An annular groove 39 is formed in the outer periphery of the rod portion inserted in the guide bore 38. A ball plunger 41 is screwed into the top end of the post 37 with its ball fitting in the annular groove 39. The guide rod 35 has a rear end fastened to the post 37.

When the handle rod 34 is pulled toward the front, the ball is forced out from the annular groove 39 against the ball biasing force of the plunger 41, rendering the bearing member 24 movable along the guide rod 35. When the handle rod 34 is pushed in in this state to trap the ball in the groove 39, the bearing member 24 is positioned in place.

The opposite seal units 25 have the same construction although oriented opposite with respect to the right-left direction. The right seal unit 25 only will be described below.

The seal unit 25 comprises a hydraulic cylinder 42 having a two-step stroke, parallel links 43 connected to the piston rod of the cylinder 42, a horizontally elongated rectangular parallelepipedal movable body 44 connected to the upper ends of the parallel links 43, a horizontal mount plate 45 attached to the top of the movable body 44 in a leftwardly projecting manner and having a top surface at the same level as the tape receiving groove 32, a pressing member 46 slidable in contact with the lower surface of leftward projecting portion of the mount plate 45 so as to be positionable inwardly of the movable body 44, a vertical rod 47 suspending the pressing member 46 from the mount plate 45 so as to be pivotally movable horizontally, a tape pushing member 48 in the form of a horizontal plate extending leftward above the pressing plate 46 and slidable in contact with the top surface of the mount plate 45, a plate spring 49 attached to the right side face of the movable body 44 to project upward and bearing on the right edge of the tape pushing member 48, a movable rod 51 slidably extending through the movable body 44 in the right-left direction so as to be positioned below the pressing member 46, a spring retainer 53 integral with the left end of the movable rod 51 and having a horizontal slit 52 in its left end face, a stopper 54 attached to the right end of the movable rod 51, a compression spring 55 provided between the movable body 44 and the spring retainer 53, and a tape holding member 57 in the form of a horizontal plate, fitted in the slit 52 and attached to the spring retainer 53 by a vertical pin 56 horizontally pivotally movably.

As best shown in FIGS. 4 and 7, a screw bore 61 is formed in the top face of the movable body 44. A cutout 62 is formed in the corner portion of the movable body 44 where the top face and the left end face thereof join.

The mount plate 45 is formed close to its right end with a stepped bolt bore 63 in register with the screw bore 61. The mount plate 45 has a small rod bore 64 positioned close to its left end and extending therethrough.

The pressing member 46 has a large rod bore 65 positioned approximately in its center and extending therethrough. The large rod bore 65 has an enlarged portion 66 at its lower-end opening edge portion. A lower horizontal ridge 68 having a forward end providing a pressing face 67 is formed at the lower edge portion of left side face of the pressing member 46. The member 46 has an upper horizontal ridge 72 providing a thermal blade 71 at its forward end and positioned above the ridge 68. The blade 71 is projected beyond the pressing face 67 toward the bearing surface 31 by an amount corresponding approximately to twice the thickness of the tape. The pressing member 46 is provided at the upper end of its right side face with a projection 73 fitting in the cutout 62, whereby the range of pivotal movement of the pressing member 46 is limited.

The vertical rod 47 comprises a small-diameter upper portion 74 inserted through the small rod bore 64 and a large-diameter lower portion 75 inserted through the large rod bore 65. The small-diameter upper portion 74 includes an upper part externally threaded as at 87. The large-diameter lower portion 75 is provided at its lower end with a flange 76 fitting in the enlarged portion 66.

The tape pushing member 48 comprises a silicone resin having a width of 28 mm and excellent in heat resistance and heat insulating properties. The pushing member 48 is preferably about 2 mm in thickness. If too thin, the member 48 is likely to cut the tape. The tape pushing member 48 is formed with a right slot 77 in register with the bolt bore 63 and a left slot 78 in register with the small rod bore 64. A tubular long spacer 81 having an outside diameter slightly smaller than the width of the right slot 77 is fitted in the right slot 77 and the bolt bore 63 and rests on the step of the bore. The spacer 81 has an upper end projecting slightly beyond the upper surface of the pushing member 48. A thrust washer 82 is placed on the upper end of the long spacer 81, and a set bolt 83 is screwed into the screw bore 61 through the thrust washer 82 and the spacer 81. A tubular short spacer 84 having an outside diameter slightly smaller than the width of the left slot 78 is fitted in the slot 78 and positioned around the small-diameter upper portion 74. The short spacer 84 has an upper end face projecting slightly beyond the upper surface of the tape pushing member 48. A thrust washer 85 is placed on the short spacer 84, and a nut 86 is screwed on the externally threaded part 87 of the vertical rod 49 and positioned on the washer 85.

With reference to FIG. 7, a sheathed heater 88 and a thermocouple 89 for controlling the temperature of the heater are embedded in the pressing member 46. The spring retainer 53 is formed with a cooling water channel 90.

Tape joining operation will be described next with reference to FIG. 1 again.

The left rewinder 11 has supported thereon the tape T to be rewound next. This tape T is reeved around the left tension roller 19 and then around the upper guide roller 21, guided to the bearing member 24, passed around the lower end of the bearing member 24 from the left side thereof and has its leading end held between the member 24 and the taper holder 33, whereby the leading end of the tape T is folded over, and the folded portion is placed along the bearing surface 31 of the member 24.

The right rewinder 11 has fastened thereto the rear end of another tape T which has just been rewound. This tape T is reeved around the right tension roller 19 and then around the upper guide roller 21, extends along the right side of the bearing member 24 to the lower guide roller 22, is passed around the lower guide roller 22 and led to the accumulator 14.

After the preceding tape T is rewound to its rear end, the drive pinch rollers 23 continue to transport the tape T. Since the rear end of the tape T is fastened to the rewinder 11 and no longer rewindable, tension then acts on the tape T, turning the brake lever 16 clockwise and moving the brake shoe 18 away from the rewinder 11 toward the tape rear end sensor 17. This movement is detected by the sensor 17, which in turn delivers a detection signal. Based on this signal, the piston rod of the hydraulic cylinder 42 makes a two-step stroke.

The operation of the hydraulic cylinder 42 advances the movable body 44 toward the bearing member 24. First, the tape holding member 57 presses the subsequent tape T and the preceding tape T as lapped thereover against the bearing member 24.

When the movable body 44 further advances, the tape pushing member 48 forces the lapped portions of these tapes T into the tape receiving groove 32. The pushing member 48, which is acted on by the plate spring 49, will not exert an objectionable force on the tapes T in this case. When pushed into the groove 32, the tapes T are tensioned.

Subsequently, the pressing member 46 is pressed against the bearing member 24 with the two tapes T interposed therebetween, whereupon the tapes T are fused at the portions thereof pressed by the pressing face 67 of the pressing member 46. At the same time, tape portions above the fused joint are cut by being melted with the thermal blade 71. If the pressing face 67 of the pressing member 46 is not parallel to the bearing surface 31 of the bearing member 24 when the pressing member 46 is pressed against the bearing member 24, the pressing member 46 is pivotally moved to position the face 67 in parallel to the surface 31. Accordingly, a reliable joint is formed over the entire width of the tapes T. The tapes T are tensioned when to be cut, so that when the tapes T are cut, the cut tape portions separate off simultaneously with cutting. This ensures reliable cutting, also eliminating the likelihood that the thermally cut portion will be fused again.

When the two tapes T are cut, the piston rod of the cylinder 42 is retracted by the first step of stroke. This moves the pressing member 46 away from the two tapes T while permitting the holding member 57 to hold the tapes T thereby pressed continuously. While the two tapes T are being held by the holding member 57, the fused portions are cooled to form a reliable joint of the two tapes T. The piston rod of the cylinder 42 is now retracted by the second step of stroke. This moves the holding member 57 away from the two tapes T.

With the start of rewinding of the subsequent tape T, the following setting work is performed. This work may be conducted before the tape T currently being rewound is completely rewound, at any time when the worker is available and convenient to him.

Another new tape is set on the right rewinder 11, and the bearing member 24 is caused to hold the leading end of the tape as reeved around the member 24 from the right side thereof this time. If the bearing member 24 is pulled out toward the front for this procedure, the leading end of the new tape T can be set on the member 24 with ease.

FIG. 8 shows a modification of tape pushing member and means for biasing this member. A cylinder 91 and a guide 92 are mounted on the upper surface of the mount plate 45. The cylinder 91 has housed therein a piston 93 and a compression spring 94 for biasing the piston toward the bearing member 24. A rod 95 has an end connected to the piston 93. The rod 95, projecting from the cylinder 91, is connected at the other end thereof to a tape pushing member 48. The guide 92 is formed with a guide bore 96 having the pushing member 48 slidably inserted therethrough.

With reference to FIG. 8, the tape holder 33 of the foregoing embodiment is replaced by a hydraulic cylinder 97. The bearing member 24 is formed in its top with a notch 99 for the outer end of piston rod 98 of the cylinder 97 to fit in with tapes T interposed therebetween.

What is claimed is:

1. A tape joining device for joining two heat-sealing tapes in alignment with each other, the device comprising:

means for holding the two tapes at portions thereof opposed to each other for joining, a fixed bearing member disposed at one of opposite sides of the opposed tape portions and having a bearing surface opposed to the opposed tape portions, a movable pressing member disposed at the other side of the opposed tape portions and having a pressing face opposed to the bearing surface, a heater for heating the pressing member, and a movable body having attached thereto the pressing member and movable toward or away from the bearing member so as to press the pressing face against the bearing surface with the opposed tape portions interposed therebetween, the tape joining device being characterized in that the pressing member is pivotally movable relative to the movable body about an axis extending in parallel to the longitudinal direction of the tapes held by the holding means.

2. A tape joining device as defined in claim 1 wherein the pressing member and the movable body have respective opposed surfaces slidable in contact with each other and orthogonal to an axis about which the pressing member is pivotally movable, the pressing member having a rod bore extending therethrough in alignment with the axis, a rod being fitted in the rod bore so as to render the pressing member free to pivotally move about the axis of the rod and to move axially of the rod, the rod having one end adjacent to the opposed surfaces and fixed to the movable body to intersect the opposed faces at right angles therewith, the rod being provided at the other end thereof with a flange bearing on an opening edge portion of the rod bore adjacent to said other rod end.

3. A tape joining device as defined in claim 1 or 2 wherein the pressing member is provided with a projection extending in a direction opposite to the pressing face, and the movable body is formed with a recess having the projection fitted therein with a clearance formed for the pivotal movement of the pressing member.

4. A tape joining device as defined in any one of claims 1 or 2 wherein the bearing member is movable between an operative position opposed to the opposed tape portions and a nonoperative position away from the operative position widthwise of the tapes, means being provided for releasably locking the bearing member in the operative position.

5. A tape joining device as defined in claim 3 wherein the bearing member is movable between an operative position opposed to the opposed tape portion and a nonoperative position away from the operative position widthwise of the tapes, means being provided for releasably locking the bearing member in the operative position.

* * * * *